US009427879B2

(12) United States Patent
Wevers et al.

(10) Patent No.: US 9,427,879 B2
(45) Date of Patent: Aug. 30, 2016

(54) DEVICE FOR TRIMMING HAIR

(75) Inventors: Dirk Hendrik Wevers, Drachten (NL); Hendrik Jan Mark Van Der Worp, Zwolle (NL); Reinier Alexander Tijssen, Zwolle (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 699 days.

(21) Appl. No.: 13/508,922

(22) PCT Filed: Dec. 8, 2010

(86) PCT No.: PCT/IB2010/055666
§ 371 (c)(1),
(2), (4) Date: May 9, 2012

(87) PCT Pub. No.: WO2011/073857
PCT Pub. Date: Jun. 23, 2011

(65) Prior Publication Data

US 2012/0240414 A1 Sep. 27, 2012

(30) Foreign Application Priority Data

Dec. 14, 2009 (EP) ..... 09178999

(51) Int. Cl.
*B26B 19/20* (2006.01)
*B26B 19/06* (2006.01)

(52) U.S. Cl.
CPC ..... *B26B 19/20* (2013.01); *B26B 19/063* (2013.01)

(58) Field of Classification Search
USPC ..... 30/201, 537, 32, 199, 289, 526–257, 30/233.5, 43, 43.91, 43.92, 200, 205, 206
See application file for complete search history.

(56) References Cited

U.S. PATENT DOCUMENTS

| | | | | |
|---|---|---|---|---|
| 2,445,530 | A * | 7/1948 | Majer | 30/201 |
| 2,916,820 | A * | 12/1959 | Clark | 30/201 |
| 3,149,418 | A * | 9/1964 | Milbourne | 30/201 |
| 4,949,460 | A * | 8/1990 | Sterk | 30/201 |
| 5,970,616 | A | 10/1999 | Wahl et al. | |
| 6,079,103 | A * | 6/2000 | Melton et al. | 30/43.92 |
| 6,505,404 | B2 | 1/2003 | Ullmann | |
| 6,536,116 | B2 | 3/2003 | Fung | |
| 6,986,206 | B2 * | 1/2006 | McCambridge et al. | 30/34.1 |
| 7,234,242 | B2 * | 6/2007 | Yao | 30/201 |
| 7,367,127 | B2 * | 5/2008 | Nakakura et al. | 30/233.5 |
| 7,698,822 | B2 * | 4/2010 | Kostner et al. | 30/216 |

(Continued)

FOREIGN PATENT DOCUMENTS

| | | |
|---|---|---|
| EP | 0147134 A2 | 7/1985 |
| EP | 0707926 A1 | 4/1996 |

(Continued)

*Primary Examiner* — Omar Flores Sanchez

(57) ABSTRACT

A device for trimming hair comprising a housing (3) and a head portion (9) with a cutting blade assembly (10), wherein the head portion (9) is rotatably mounted to the housing (3) and a comb attachment (20) is releasably attachable to the device to extend over the cutting blade assembly (10), the device further comprising a locking means (30,50) configured to fixedly engage the head portion (9) with the housing (3) when a comb attachment (20) is detached from the device such that the head portion (9) is prevented from rotating relative to the housing (3) and configured to disengage the head portion (9) from the housing (3) when a comb attachment (20) is attached to the device such that the head portion (9) is rotatable relative to the housing (3).

22 Claims, 12 Drawing Sheets

(56) References Cited

U.S. PATENT DOCUMENTS

| | | | | |
|---|---|---|---|---|
| 7,975,387 | B2 * | 7/2011 | Mikula et al. | 30/201 |
| 2005/0246902 | A1 | 11/2005 | Poran | |
| 2008/0295340 | A1 | 12/2008 | Carlucci et al. | |

FOREIGN PATENT DOCUMENTS

| | | | |
|---|---|---|---|
| GB | 2383970 | A | 7/2003 |
| WO | 2007060590 | A2 | 5/2007 |
| WO | 2008099281 | A2 | 8/2008 |

* cited by examiner

DEVICE FOR TRIMMING HAIR

FIELD OF THE INVENTION

The present invention relates to a device for trimming hair. In particular, the present invention relates to a device for trimming hair including a housing with a head portion which is rotatably mounted to the housing.

BACKGROUND OF THE INVENTION

Electric hair cutting appliances are generally known, and include trimmers, clippers and shavers whether powered by mains supplied electricity or batteries. Such a device is generally used to trim body hair, in particular facial and head hair to allow a person to have a well groomed appearance.

Commonly, conventional devices for cutting hair comprise a main body forming an elongate housing having a front or cutting end and an opposite handle end. A cutting blade assembly is disposed at the cutting end and includes a stationary blade element with a movable blade element which moves in a reciprocal manner against the stationary blade element. The cutting blade assembly extends from the cutting end and is fixed in a single position relative to the body, such that the orientation of the cutting element is determined by a user orientating the main body of the device.

A comb attachment is generally mounted to the cutting end of a conventional device to position hair to be cut by the cutting blade assembly. Typically, the comb attachment slides over the cutting blade assembly and spaces the cutting elements away from the surface of the skin from which the hair extends. This allows a uniform length of hair to be cut and allows different sizes of comb elements to be attached, or an adjustable comb element to be attached, to vary the length of hair to be cut.

Further, it is also possible to remove the comb attachment from the cutting end so that the blade assembly is exposed. This allows the cutting assembly to be used for precise trimming of hair, particular outer contours of the a hairline or beard.

However, one problem with such conventional devices is the fixed relationship between the housing and the cutting blade assembly and comb attachment. As the cutting blade assembly and comb attachment is fixedly mounted to the main body, it is necessary to correctly align the cutting blades by moving the handle into the correct orientation. Therefore, a user must position their hand and arm in potentially awkward or uncomfortable positions. Furthermore, if a user does not precisely orientate the device, then the cutting blade assembly will be orientated incorrectly, which leads to an unsatisfactory hair cut or trim. It is often difficult for a user attempting to trim their own hair to handle a conventional device, because of the low visibility to the back of the head during use and so the possibility of the user injuring themselves, or getting an unequal haircut, is very high.

In view of the foregoing, devices for cutting hair have been devised with a pivotable head on which is mounted the blade assembly and comb attachment. The head is allowed to pivot so that the blade assembly and comb attachment are able to align with the contours of the head and provide a more uniform cut. Furthermore, it is easier and more comfortable for a user to trim their own hair when the comb attachment has some rotational freedom during use which enables, the comb attachment and hence the blade assembly to follow the shape of the human head.

However, the pivotable head is a disadvantage when it is desired to conduct precise trimming of the hair when the comb element is removed. In such a situation, there is the problem that it is difficult to precisely position the cutting element when the head is inclined to pivot relative to the body, and so can cause irregular and undesired cuts.

SUMMARY OF THE INVENTION

Therefore, it is an object of the invention to provide a device for clipping hair which substantially alleviates or overcomes the problems mentioned above and allows the precise positioning of a cutting blade arrangement when a comb element is removed from the device.

According to the present invention, there is provided a device for trimming hair comprising a housing and a head portion with a cutting blade assembly, wherein the head portion is rotatably mounted to the housing and a comb attachment is releasably attachable to the device to extend over the cutting blade assembly, the device further comprising a locking means configured to fixedly engage the head portion with the housing when a comb attachment is detached from the device, such that the head portion is prevented from rotating relative to the housing, and disengage the head portion from the housing when a comb attachment is attached to the device, such that the head portion is rotatable relative to the housing.

Preferably, the locking means further comprises a locking member which is configured to move between an engaged position, in which the head portion is prevented from rotating relative to the housing, when a comb attachment is detached from the device, and a disengaged position, in which the head portion is rotatable relative to the housing, when a comb attachment is attached to the device.

The locking member may be urged into its disengaged position by a comb attachment acting on the locking member.

In a preferred embodiment, the device further comprises resilient means to urge the locking member from its engaged position into its disengaged position.

The locking member may be mounted in the housing.

Conveniently, the locking means further comprises a locking protrusion which rotates with the head portion such that, when the locking member is in its engaged position, the locking member abuts against the locking protrusion to prevent the head portion from pivoting relative to the housing.

The device may further comprise a motor assembly disposed in the housing to drive the cutting blade assembly, wherein the motor assembly rotates with the head portion and the locking protrusion extends from the motor assembly.

Advantageously, the locking protrusion extends in a radial direction from the axis of rotation of the motor assembly, and the locking member moves along an axis parallel to the axis of rotation.

In one embodiment, the locking member is mounted on the head portion.

Preferably, the locking member further comprises a slot and the locking means further comprises a locking pin which is locatable in the slot to fixedly mount the head portion relative to the housing and prevent rotation relative thereto.

The locking pin may be disposed on the housing.

The locking member may further comprise an arcuate face, along which the locking pin slides when the locking member is urged into its engaged position.

Conveniently, an arm of the locking member extends through an aperture in the head portion against which a comb attachment abuts to urge the locking member.

Advantageously, the device further comprises a comb attachment releasably mounted to the head portion.

Preferably, the comb attachment comprises an urging protrusion which acts on the locking member to urge the locking member into its disengaged position.

BRIEF DESCRIPTION OF THE DRAWINGS

Preferred embodiments of the invention will now be described, by way of example only, with reference to the accompanying drawings, in which.

DETAILED DESCRIPTION OF THE EMBODIMENTS

Figure 1:
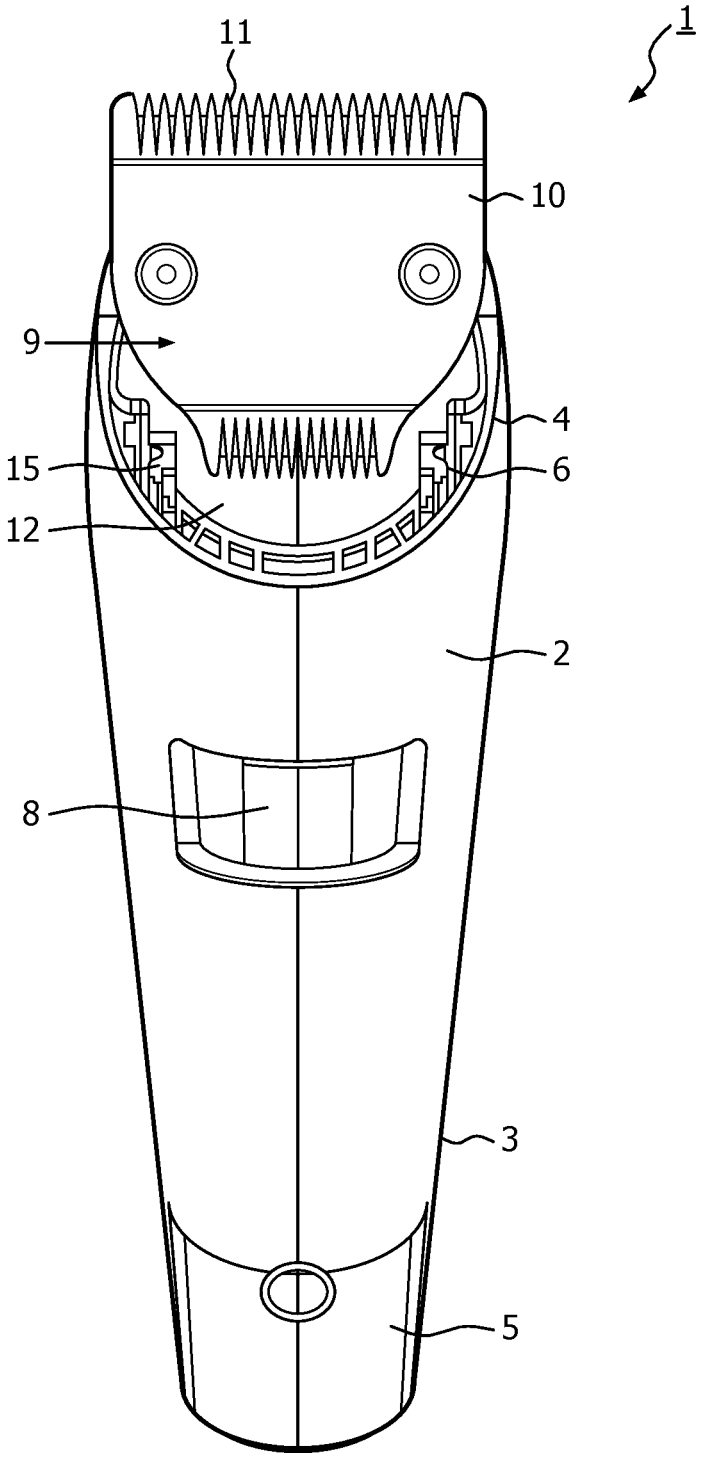
FIG. 1 illustrates a perspective view of a device for clipping hair according an embodiment of the present invention.
Figure 2:
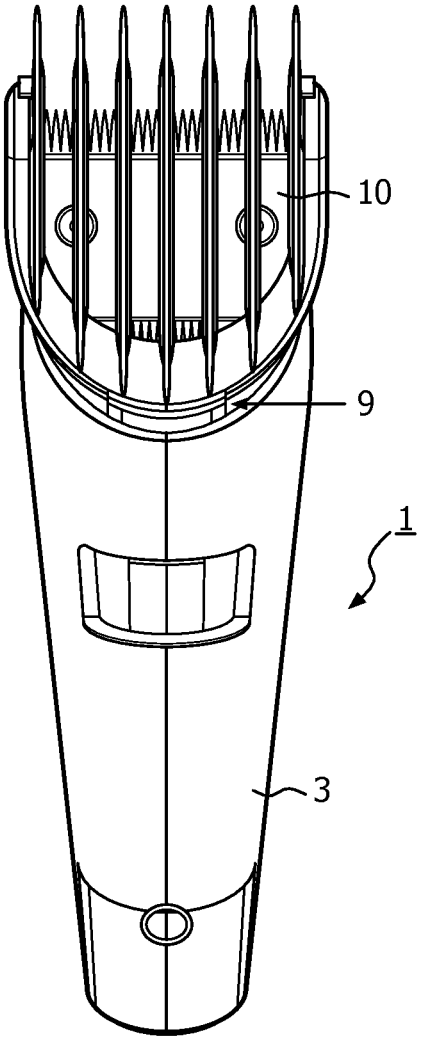
FIG. 2 illustrates a perspective view of the device shown in FIG. 1, showing a head portion in a neutral position with a comb attachment attached thereto.
Figure 3:
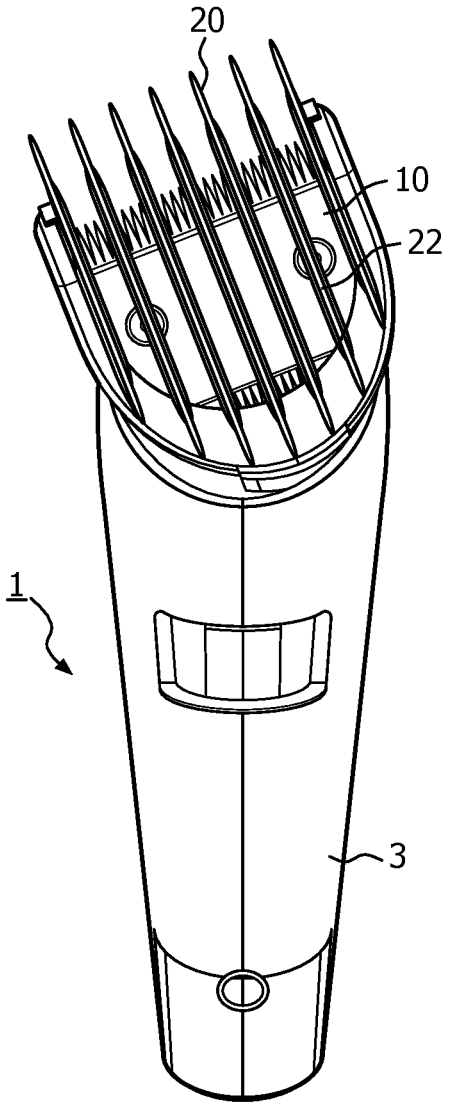
FIG. 3 illustrates a perspective view of the device shown in FIG. 2, with the head portion and comb attachment rotated in an anti-clockwise direction relative to the main body.

Referring now to the drawings, there is shown in FIGS. 1 to 13 a first embodiment of a device for trimming hair 1 comprising a body 2 including an elongate housing 3 with a cutting or front end 4, and a handle or rear end 5. An opening 6 is formed in the front end 4 of the body 2 and a head portion 7 extends from the body 2 and is mounted thereto.

The outer surface 7 of the elongate housing 3 is tapered outwardly from the rear end 6 to the front end 4 to provide a more ergonomic holding position and to improve the aesthetic appearance of the device 1, although it will be appreciated that other housing arrangements are envisaged. An operating button 8 is provided on the housing to operate the device 1, as will be explained hereinafter.

A cutting blade assembly 10 is mounted on the head portion 9, and comprises a first fixedly mounted blade (not shown) and a second movable blade (not shown) abutting against the first fixedly mounted blade. Each blade (not shown) has an array of teeth at a cutting edge 11 of the blade assembly 10 which overlap with each other so that, when the second movable blade moves in a reciprocal linear manner relative to the first blade, edges of the teeth form a cutting surface that engages and severs the hair. Such a cutting blade assembly 10 is conventional and so no further discussion of the arrangement will be given herein. Although the present embodiments are described with respect to the above cutting blade arrangement, it will be appreciated that the cutting blade assembly is not limited thereto and that alternative cutting blade arrangements are envisaged, such as a rotational blade arrangement.

Figure 4:
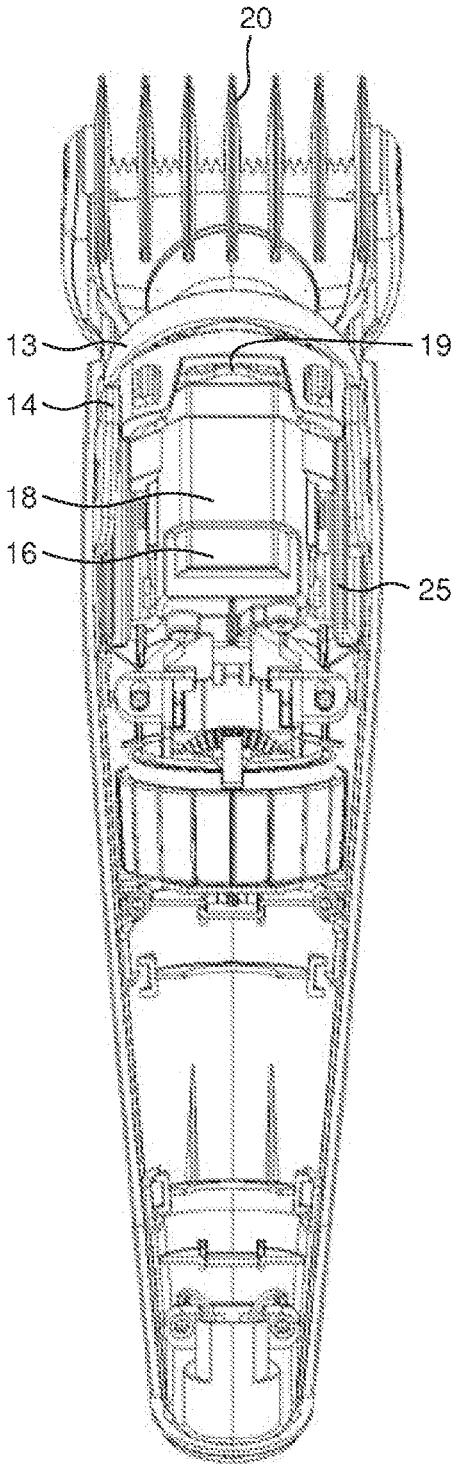
FIG. 4 illustrates a cut-through perspective view of the device shown in FIG. 1, with the head portion and comb attachment in a neutral position relative to the main body.
Figure 5:
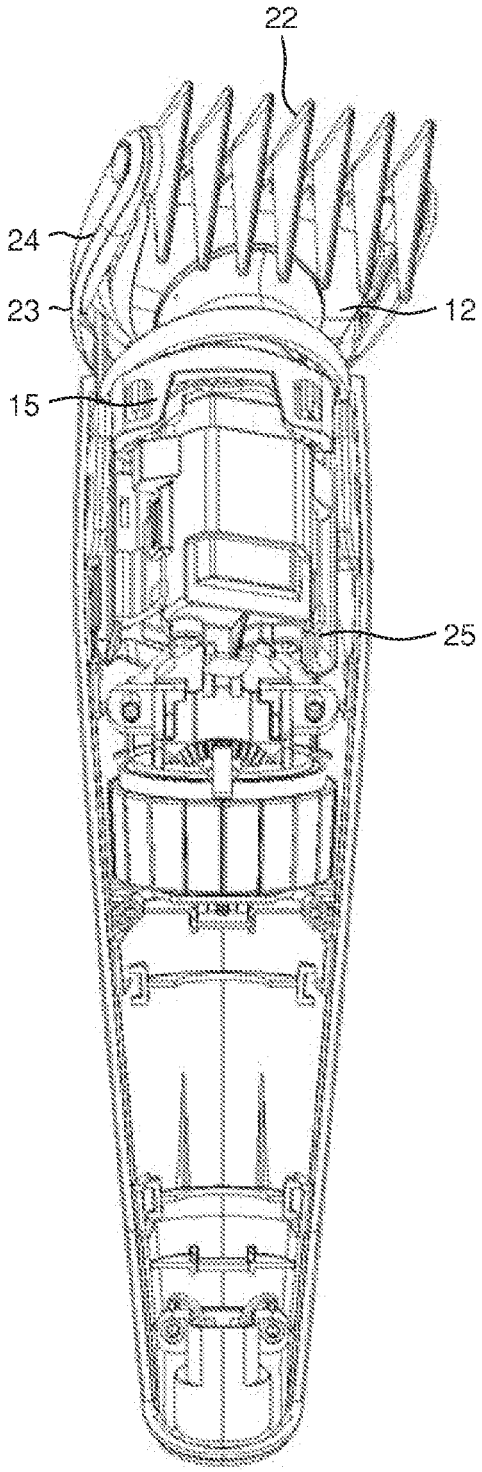
FIG. 5 illustrates a cut-through perspective view of the device shown in FIG. 4, with the head portion and comb attachment rotated relative to the main body.
Figure 6:
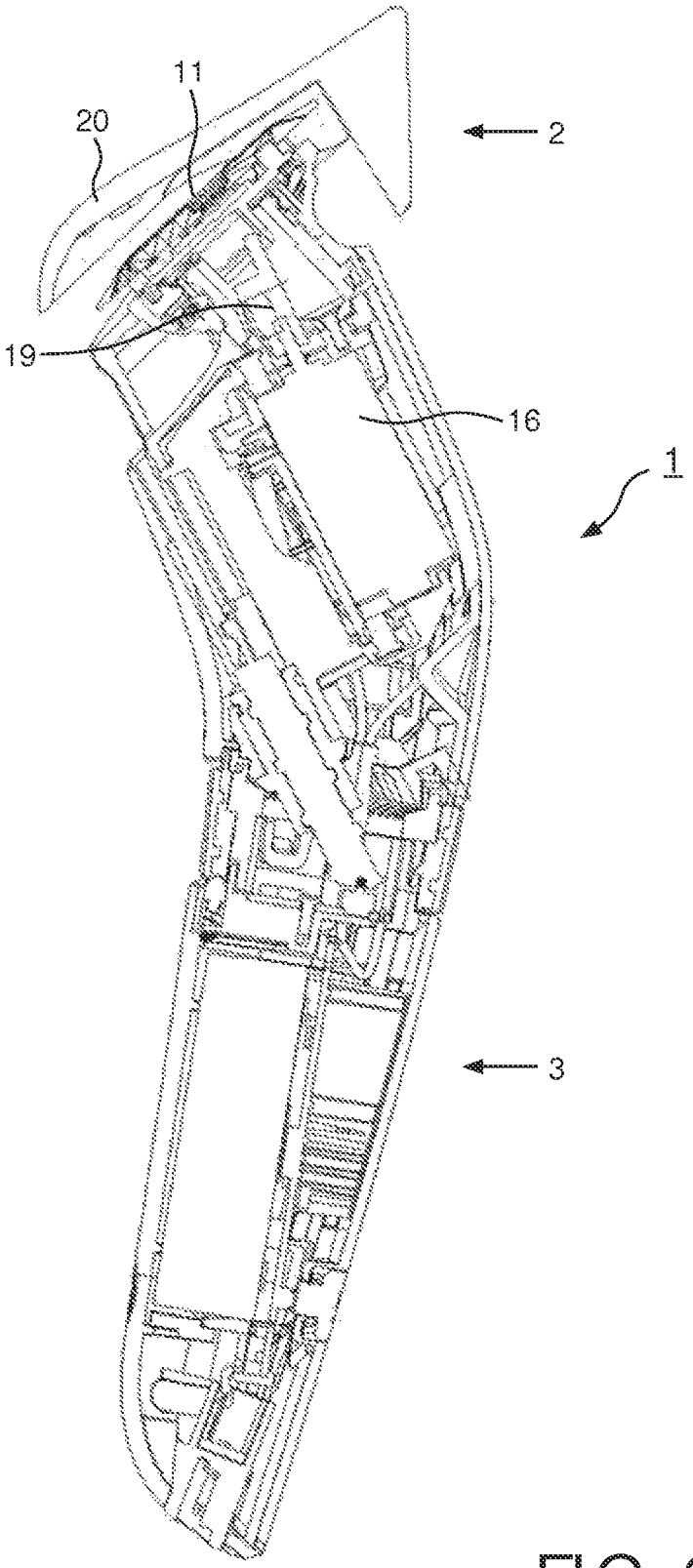
FIG. 6 illustrates a sectional view of the device shown in FIG. 1.
Figure 7:
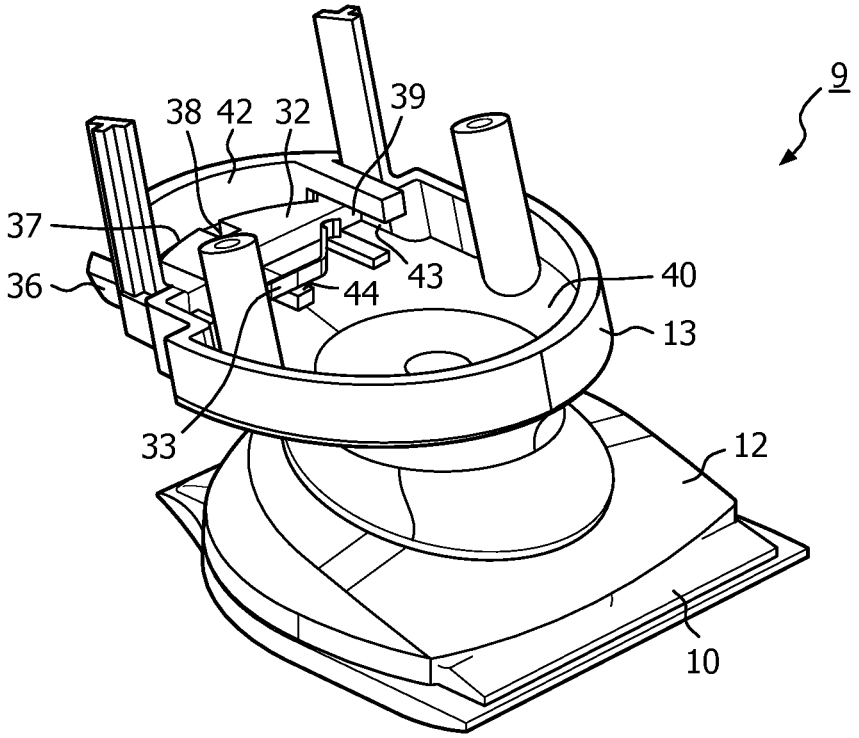
FIG. 7 illustrates a perspective view of the head portion of the device shown in FIG. 1, according to one embodiment of the invention.
Figure 8:
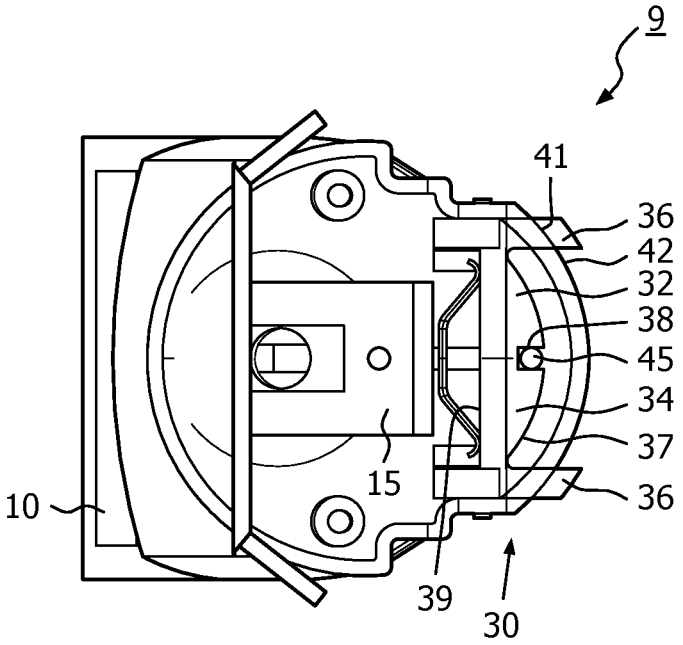
FIG. 8 illustrates a plan view from below of the head portion of the device shown in FIG. 7 with a sub-frame of the housing and a locking pin, and a locking member shown in an engaged position with the locking pin.
Figure 9:
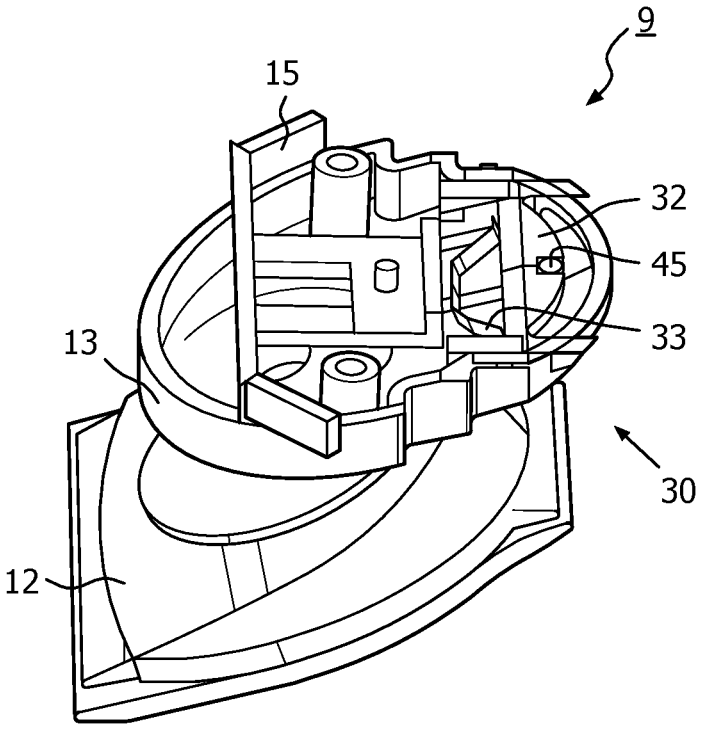
FIG. 9 illustrates a perspective view of the head portion of the device shown in FIG. 8.
Figure 10:
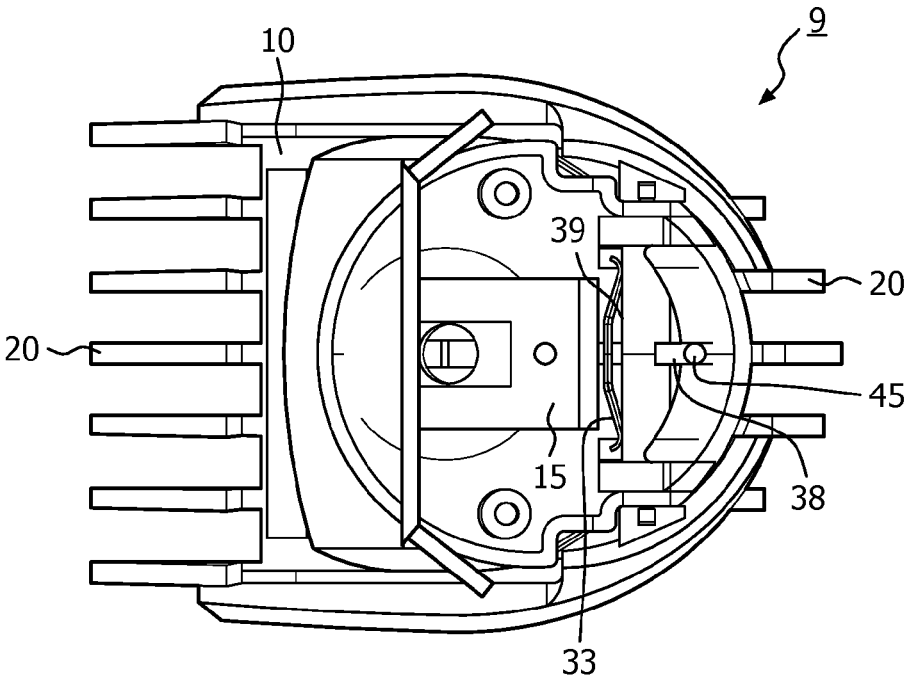
FIG. 10 illustrates a plan view from below of the head portion of the device shown in FIG. 7 with a sub-frame of the housing, a locking pin, and a comb attachment attached, and the locking means shown in a disengaged position away from the locking pin.
Figure 11:
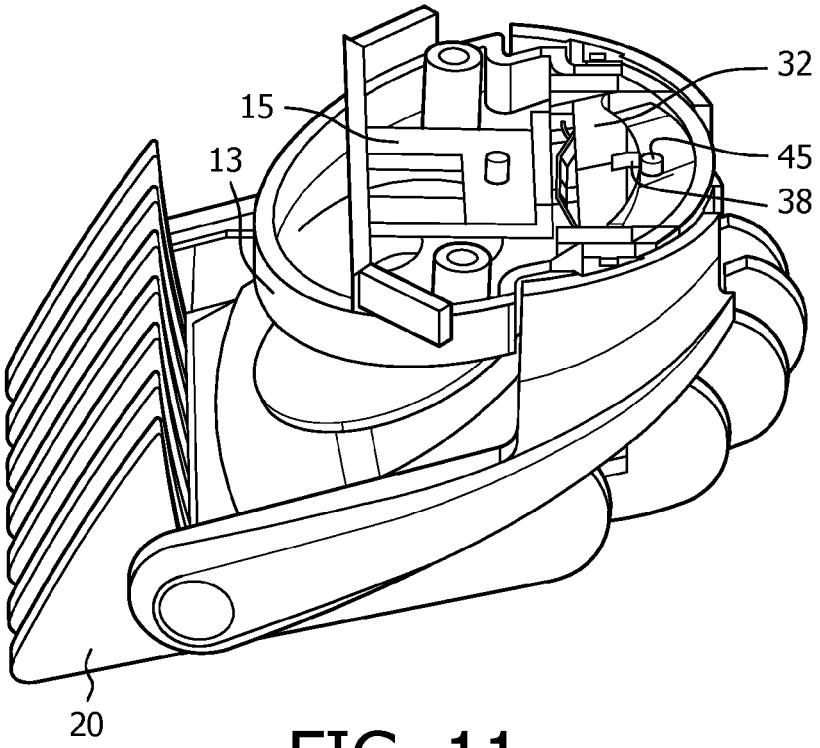
FIG. 11 illustrates a perspective view from below of the head portion of the device shown in FIG. 10.
Figure 12:
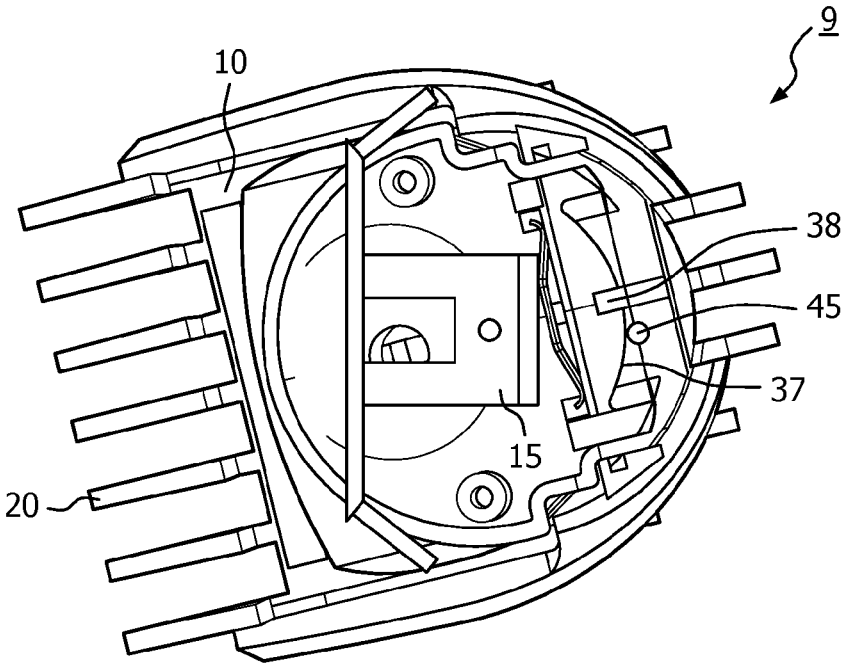
FIG. 12 illustrates a plan view from below of the head portion of the device shown in FIG. 7 with a sub-frame of the housing, a locking pin, and a comb attachment attached, and the locking means shown in a disengaged position away from the locking pin, wherein the head portion is rotated with respect to the sub-frame of the housing.
Figure 13:
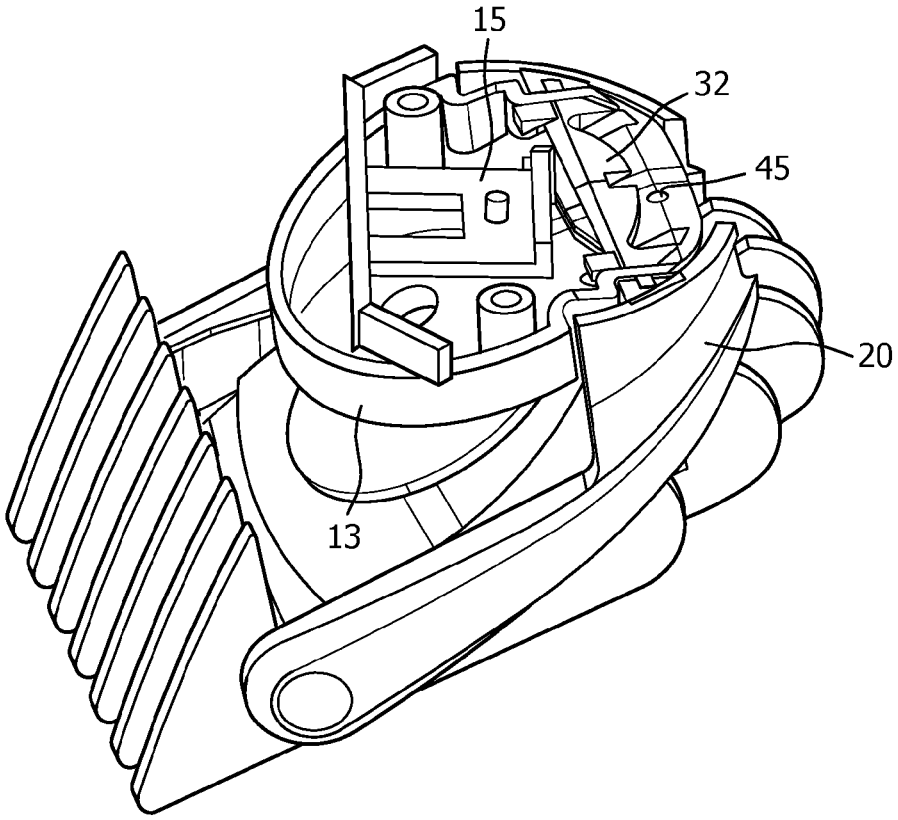
FIG. 13 illustrates a perspective view from below of the head portion of the device shown in FIG. 12.
Figure 14:
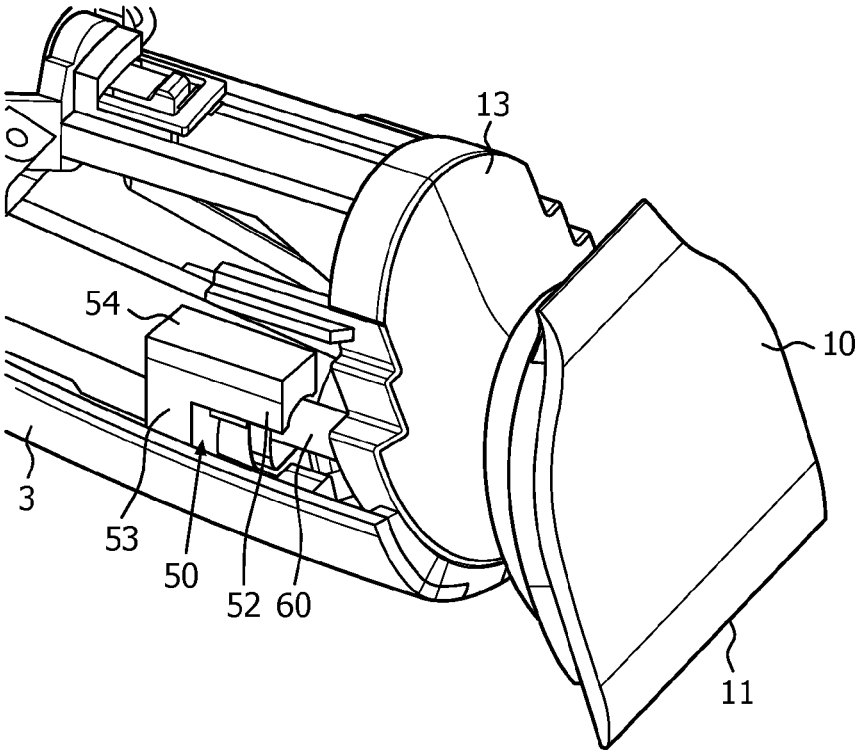
FIG. 14 illustrates a perspective view of part of the device shown in FIG. 1 according to another embodiment of the invention.
Figure 15:
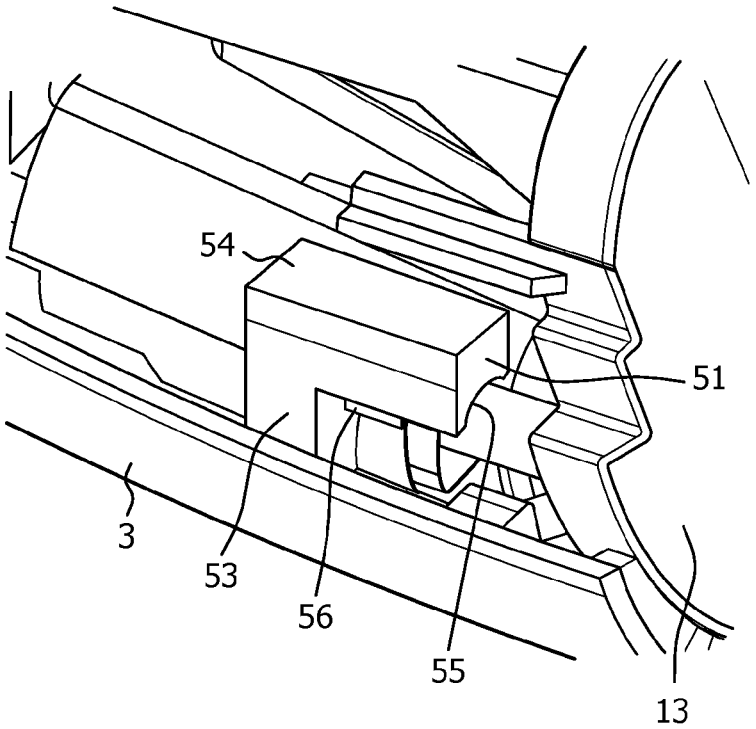
FIG. 15 illustrates a magnified perspective view of the part of the device shown in FIG. 14 with a locking means in an engaged position.
Figure 16:
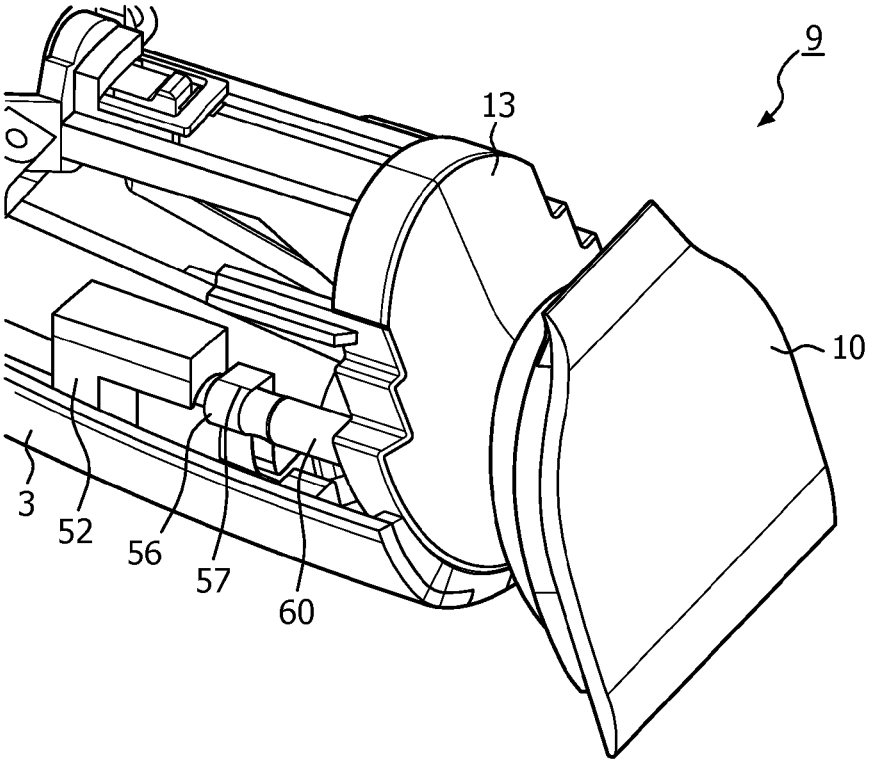
FIG. 16 illustrates a perspective view of the part of the device shown in FIG. 14 with a locking means in an engaged position, but a with a comb attachment omitted.
Figure 17:
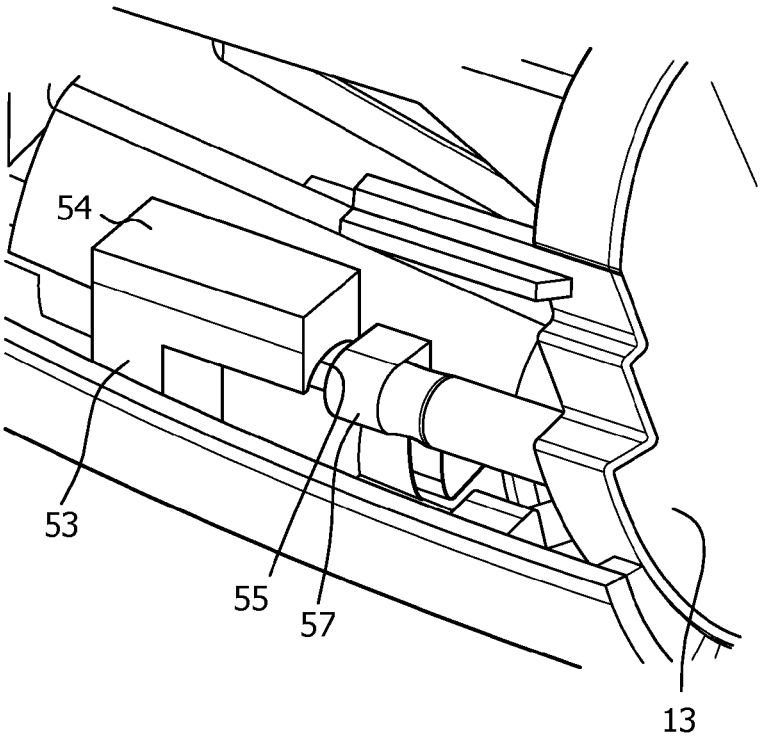
FIG. 17 illustrates a magnified perspective view of the part of the device shown in FIG. 16 with a locking means in an engaged position, but a with a comb attachment omitted.
Figure 18:
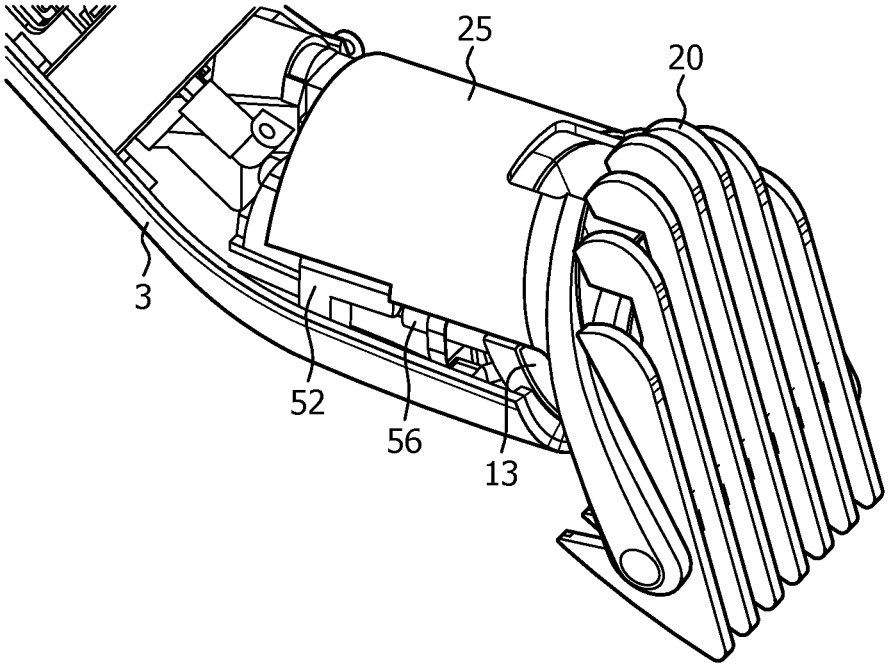
FIG. 18 illustrates a perspective view of the part of the device shown in FIG. 14 with a comb attachment shown attached.
Figure 19:
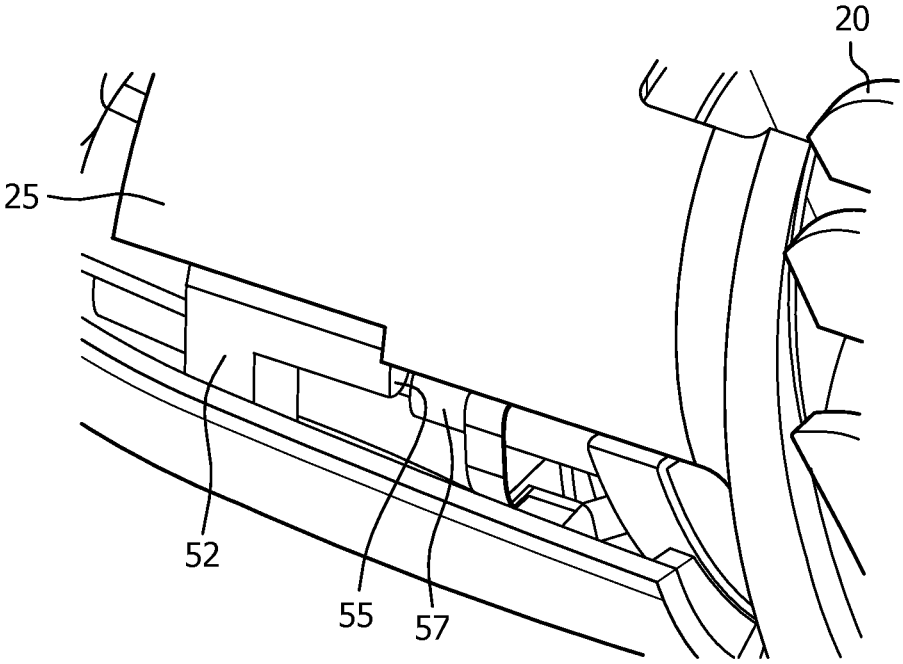
FIG. 19 illustrates a magnified perspective view of the part of the device shown in FIG. 18 with a comb attachment shown attached.
Figure 20:
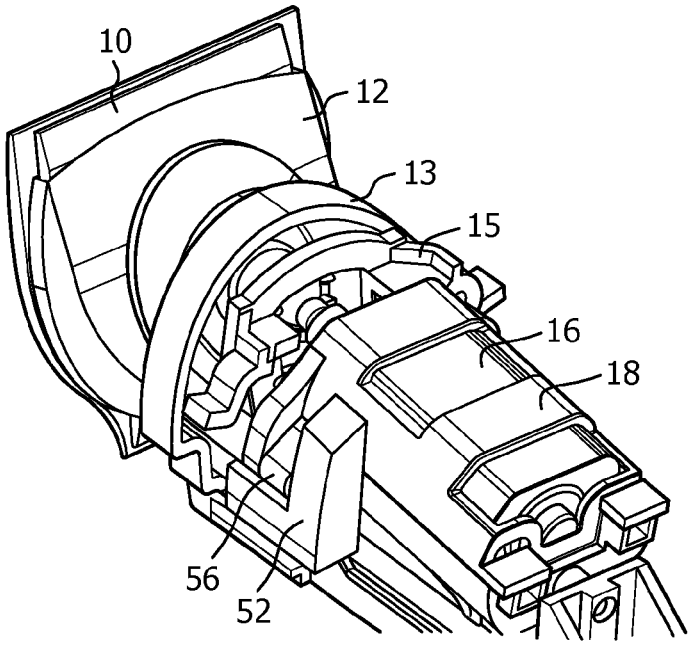
FIG. 20 illustrates another perspective view of the part of the device shown in FIG. 14 with the locking means in an engaged position.
Figure 21:
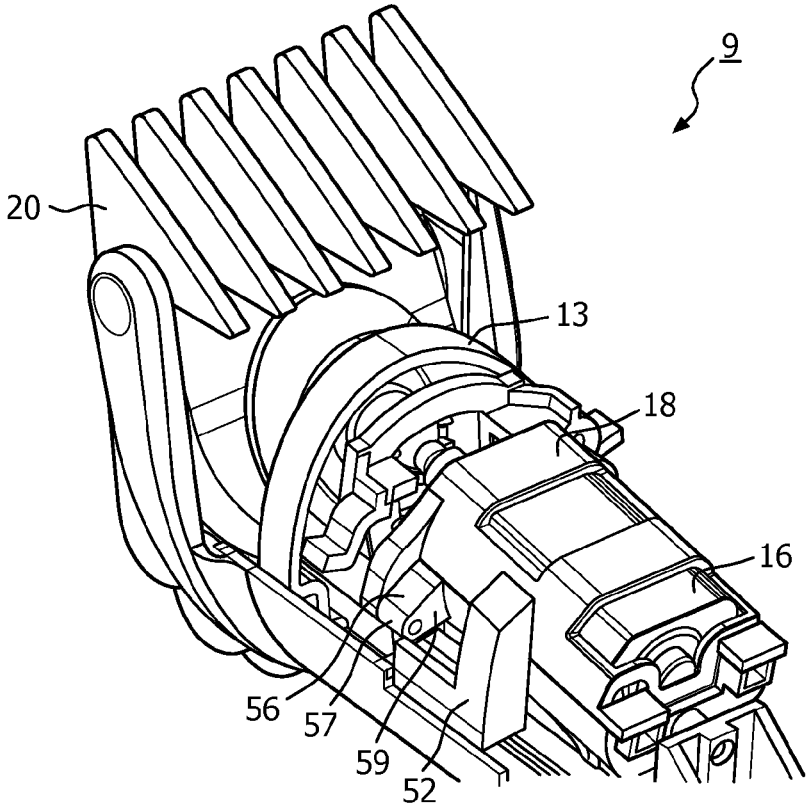
FIG. 21 illustrates another perspective view of the part of the device shown in FIG. 20 with a comb attachment attached and the locking means in a disengaged engaged position.

Referring to FIGS. 4, 5 and 7 to 13, the head portion 9 further comprises a chassis 12 to which the cutting blade assembly 10 is mounted, and an end cover 13 which extends into the housing 3. The chassis 12 and the end cover 13 are fixedly mounted to each other, or formed together. Referring now to FIGS. 4 and 5, the end cover 13 extends into the housing 3 and covers the opening 6 to the housing 3, and the head portion 9, including the chassis 12 and end cover 13, is pivotally mounted to the front end 4 of the body 2. Therefore, the head portion 9 is pivotable about a longitudinal axis extending through a plane of the head portion 9 and extending longitudinally through the elongate housing 3. Alternatively, the head portion 9 pivots on a plane extending at an oblique angle to the longitudinal axis extending along the elongate housing 3. The cutting edge 11 of the blade assembly 10 extends from the chassis 12 to allow hair to be trimmed, as will be explained in detail hereinafter.

The end cover 13 is supported on an arcuate shoulder 14 extending around the inner surface of the housing 3 proximate to the opening 6. An upper lip (not shown) extends over the periphery of end cover 13 to rotatably mount the end cover 13 and therefore the head portion 9 to the housing 3, such that the head portion 9 extends from the housing 3. The housing 3, chassis 12 and end cover 13 are formed from a moulded plastic; however it will be appreciated that any suitable material may be used.

A sub frame 15 is fixedly mounted in the housing 3 proximate the front end 4 of the body 2 and extends substantially across the opening 6 to the housing 3. A motor assembly is disposed in the housing 3 to drive the cutting blade assembly 10 and comprises an electric motor 16 mounted in a motor housing 18. The electric motor 16 is electrically connected to a battery (not shown) disposed in an electrical component space 17 formed proximate to the rear end 5 of the housing 3. Although in the present embodiments electrical power is provided by a battery, it will be appreciated that it is envisaged that electrical power may be supplied by alternative means, for example a mains power lead connecting with a connector (not shown) formed at the rear end 5 of the housing 3.

The motor assembly 18 is rotatably mounted in the housing 3 at one end of the assembly such that the motor housing 18 and the motor 16 mounted in the motor housing 18 is rotatable in the housing 3 about an axis extending substantially longitudinally in the housing 3. An actuating rod 19 extends from the electric motor 16 and extends through the sub frame 15 to a cutting blade actuating mechanism 20 which extends through an aperture 20 (refer FIGS. 8 and 9) formed in the end cover 13 and the chassis 12 to transmit the operative power of the electric motor 16 to the cutting blade assembly 10 to drive the cutting blade assembly 10.

Therefore, the motor assembly is fixedly connected to the head portion 9, such that when the head portion is urged to rotate relative to the housing 3, the motor assembly is urged to rotate therewith.

A return spring (not shown) is mounted to the motor housing 18 to urge the motor housing 18 and therefore the electric motor 16 and the head portion 9 into a neutral position, whereby the head portion 9 is not rotated relative to the housing 3.

A comb attachment 20 is releasably attached to the head portion 9 and is rotatable with the head portion 9. The comb attachment 20 guides the hair to the cutting blade assembly 10 and allows a uniform length of hair to be cut by spacing the cutting edge 11 of the cutting blade assembly 10 from the surface of a user's head. The comb attachment 14 comprises a plurality of parallel rails 22 evenly spaced from each other such that hair is guided between the rails 22 to the cutting edge 11 of the blade assembly 10. The rails 22 extend from a support section 23 which mounts to the head portion 9. In the present embodiment, the distance from the outer edge of the rails 22 to the cutting edge 11 of the cutting blade assembly 10 is variable to allow different lengths of hair to be cut. However, it will be appreciated that different comb attachments may be used to vary the distance between the cutting edge 11 of the blade assembly 10 and the outer edge of the rails 22. The comb attachment is formed from a moulded plastic; however it will be appreciated that any suitable material may be used.

The support section 23 of the comb attachment 20 comprises a pair of outer arm portions 24 from which the rails 22 extend, and an elongate arcuate mounting section 25 which extends from the outer arm portions 24. When the comb attachment 20 is mounted to the head portion 9, the arcuate mounting section 25 extends into the housing 3. Although the comb attachment 20 is described herein as being fixedly attached to the head portion 9, it will be appreciated that in an alternative embodiment the comb attachment 20 may be slidably attached to the body 2, such that the comb attachment 20 is retained by the body 2, but is capable of rotating relative to the body 2.

A retaining mechanism (not shown) retains the comb attachment 20 in place and prevents it from falling off, but allows the comb attachment 20 to be easily removed when a suitable amount of force is applied.

Referring now to FIGS. 7 to 13, a locking means 30 according to a first embodiment of the present invention is shown. The locking means 30 prevents rotation of the head portion 9 relative to the housing 3 when the head portion 9 is urged to rotate. The head portion locking means 30 is engaged to prevent rotation of the head portion 9 when the comb attachment 20 is attached to the head portion 9, and is disengaged to allow rotation of the head portion 9 due to the head portion 9 being urged to rotate when the comb attachment 20 is removed from the head portion 9.

The head portion locking means 30 comprises a locking member 32 and a resilient element 33. The locking member 32 has a central engaging portion 34 with upper and lower planar faces and an arcuate edge 37. An engaging slot 38 is formed in the central engaging portion 34 extending into the central engaging portion 34 from a mid-point of the arcuate edge 37. Parallel urging arms 36 extend from opposing side edges of the locking member, spaced by the central engaging portion 34. A flat edge 39 extends along the opposite side to the arcuate edge 37 against which the resilient element 33 locates.

The end cover 13 comprises an end face 40 and an outer wall 42 upstanding from the peripheral edges of the end face 40 and extending there around to form a recessed region. Opposing parallel tracks 43 are formed in the recessed region extending to the outer wall 42 of the end cover 13 in which opposing side edges of the locking member 32 and the parallel urging arms 36 locate so that the locking member 32 is slidable along the tracks 43. An aperture 41 is formed through the outer wall 42 at the end of each track 43 such that the parallel urging arms 36 are slidable through each aperture to extend from the outer face of the outer wall 42.

A resilient element locating pin 44 upstands in the recessed region of the end cover 13 and the resilient element 33 locates between the locating pin 44 and the locking member 32. The resilient element 33 in this embodiment is a compression spring which urges the urging arms 36 through the apertures in the outer wall 42 to extend from the end cover 13.

A locking pin 45 (refer to FIGS. 8 and 9) upstands from the sub-frame 15 and extends into the recessed region of the end cover 13. The locking member 32 is urged against the locking pin 45, and so the locking pin 45 locates against the arcuate edge 37 or in the slot 38, dependent on the rotatable orientation of the head portion 9 with respect to the body 2, as will be explained hereinafter.

Operation of the above embodiment will now be described with reference to FIGS. 1 to 13, and in particular FIGS. 8 to 13.

A user holds the device for clipping hair 1 by the elongate housing 3, and the comb attachment is initially detached from the head portion 9. In this situation the resilient element 33 urges against the flat edge 39 of the locking member 32 to urge the locking member 32 towards the outer wall 42 of the end cover 13 such that the urging arms 36 are urged through the apertures in the outer wall 42 to extend from the end cover 13. The head portion 9 is initially in a neutral position, in which the head portion 9 is not rotated relative to the body 2. In the neutral position, with the comb attachment detached from the head portion 9 (refer to FIGS. 8 and 9), the resilient element 33 urges the locking member 32 towards the locking pin 45 and so the locking pin 45 locates in the slot 38 formed in the locking member 32. As the locking pin 45 upstanding from the sub-frame 15 fixedly mounted in the housing 3 is located in the slot 38 of the locking member 32 mounted to the end cover 13 of the head portion 9, the head portion 9 is fixedly mounted to the housing 3 and so is prevented from rotating relative to the housing 3.

The comb attachment 20 is then slid over the head portion 9, with the elongate arcuate mounting section 25 sliding into the housing 3 and the rails extending over the cutting blade assembly 10. The mounting section 25 removably mounts to the end cover 13 and the retaining mechanism (not shown) fixedly holds the comb attachment 20 in place. Although in the present embodiment the comb attachment fixedly mounts to the end cover 13, it will be appreciated that the comb attachment 20 may be fixedly connected to a component, such as the motor housing 18 which rotates together with the head portion 9. The comb attachment 20 may also mount to an adjustment mechanism (not shown), which is configured to move the rails 22 towards and away from the cutting blade assembly 10. This enables the spacing between the cutting edge 11 of the cutting blade assembly 10 and the rails 22 to be varied and so change the length of hair to be cut by a user.

As the comb attachment 20 is slid over the head portion 9, contact surfaces (not shown) of the mounting section 25 contact angled end surfaces (not shown) of the urging arms 36. The end surfaces of the urging arms 36 are therefore urged towards the outer wall 42 of the end cover 13 such that the locking member 32 is urged against the resilience of the resilient element 33 and urged away from the locking pin 45. Therefore, the locking pin 45 slides out of the slot of the locking member 32, and so slides from an engaged position, in which the head portion is prevented from rotating relative to the body 2, to a disengaged position, whereby the locking member 32 is retained away from the locking pin 45 and the head portion 9 is rotatable relative to the body 2 (refer to FIGS. 10 and 11).

It will be understood that the locking member 32 is retained in its disengaged position whilst the comb attachment 20 is attached to the head portion 9. The user then operates the device 1 by use of the operating button 8. Electrical power is supplied to the electric motor 16 by power supply means, such as a battery, disposed in the electrical component space 17. The motor 16 then drives the cutting blade assembly 10 in a conventional manner, and the device 1 is then operable to trim hair.

As a user applies the device to a human head with hair to be cut, the head portion 9 is free to pivot relative to the body 2 because the head portion 9 has some rotational freedom. Therefore, it is easier and more comfortable to use, because the head portion 9 and comb attachment 20 are rotatable to follow the shape of a human head. As the head portion 9 rotates, together with the comb attachment 20, the motor 16 and motor housing 18 rotate therewith because they are rotatably mounted in the housing 3 and are physically connected thereto by means of the actuating rod 19. Therefore the cutting efficiency of the device is retained.

When a user removes the device from the human head, the head portion 9 and comb attachment 20 rotate back into the neutral position due to one or more return springs (not shown) mounted in the housing and fixedly attached to the motor housing 18, which in turn is physically mounted to the head portion 18. However, it will be appreciated that in another embodiment the return springs may be mounted directly to the head portion 9.

If a user desires to use the device to precisely style the outer contours of the hair or the like, then the user detaches the comb attachment 20 from the head portion 9. When the user exerts a detaching force on the comb attachment 20 by pulling it away from body 2, then the comb attachment is released from the retaining mechanism (not shown) and the comb attachment slides from the head portion 9. The urging arms 36 are then released and so the resilient element 33 urges the locking member 32 towards the locking pin 45. The locking pin 45 then locates in the slot 38 of the locking member 33 to engage the locking member 33, and so the head portion 9 is fixedly mounted relative to the body 2 and is prevented from rotating. This aids the precise trimming of hair when the comb attachment 20 is not attached to the head portion 9.

If a user removes the comb attachment whilst the head portion 9 is in a rotated position (refer to FIGS. 12 and 13), then the urging arms 36 are released and the locking member 32 is urged towards the locking pin 45 by the resilient element 33. The locking pin 45 then abuts against the arcuate surface 37 of the locking member 32. The return springs (not shown) urge the head portion 9 into the neutral position and the locking pin 45 slides along the arcuate surface 37 of the locking member 32. As the head portion 9 locates in its neutral position, whereby the head portion 9 is not rotated relative to the body 2, the locking pin 45 slides into the slot of the locking member 32 to engage therewith due to the resilience of the resilient element 33 urging the locking member 33 towards the locking pin 45. The head portion 9 is then prevented from pivoting relative to the body 2.

Another embodiment of a device for clipping hair will now be described with reference to FIGS. 1 to 6 and 14 to 21. The arrangement of this embodiment of a device for clipping hair is generally the same as for the exemplary embodiment described in detail above, and so a detailed description will be omitted herein, and components corresponding to components of the preceding embodiment retain the same reference numerals.

However in this embodiment, a head portion locking means 50 is disposed in the housing 3 of the device 1. The head portion locking means 50 comprises two locking members 52 slidably mounted in the housing 3 diametrically opposite each other and two corresponding resilient elements 53. Each locking member 52 comprises an upright section 53 and a transverse locking section 54 extending from the upright section 53 (refer to FIGS. 14 to 17). The transverse locking section 54 has an arced contact surface 55 which locates against a respective locking protrusion 56, as will become apparent hereinafter.

Each locking member 52 is slidably mounted to the housing 3 and each locking member 52 has a resilient element (not shown) acting on it to urge the locking members 52 in a longitudinal direction of the elongate housing 3 towards the head portion 9. In the present embodiment, the resilient elements (not shown) are compression springs, although other resilient means may be used, for example tension springs. Each locking member 52 further includes an end face 51 against which the comb attachment 20 acts, as will be explained below.

A pair of locking protrusions 56 radially extend from the motor housing 18, with a locking protrusion 56 extending from either side of the housing 18. Each locking protrusion 56 has a locating surface 57 which abuts against the contact surface 55 of the respective locking member 52.

The comb attachment 20 is generally the same as the comb attachment described above for the first exemplary embodiment, however in this embodiment the comb attachment has two inwardly facing tabs (not shown) extending radially inwardly from the mounting section 25 of the comb attachment 20. Each inwardly facing tab (not shown) abuts against a respective end face 51 of the locking members 52 to urge the locking members 52 in a direction away from the head portion 9 when the comb attachment 20 is attached to the head portion 9. Each tab (not shown) extends in a circumferential direction to form an inner ridge.

Operation of the above embodiment will now be described with reference to FIGS. 1 to 6 and 14 to 21.

To trim or cut hair using the device for clipping hair 1, a user holds the device by the elongate housing 3, and the comb attachment is initially detached from the head portion 9. Each locking member 52 is urged by its respective resilient element (not shown) towards the respective locking protrusion 56, and its movement is limited by an end stop (not shown). The head portion 9 is initially in a neutral position, such that the head portion 9 is not rotated relative to the body 2. In the neutral position, with the comb attachment detached from the head portion 9, each resilient element (not shown) urges each locking member 52 towards its respective locking protrusion 56, and so the contact surface 55 of each locking member 52 locates against the locating surface 57 of each locking protrusion 56 extending from the motor housing 18. As the motor housing 18 is connected to head portion 9 by the actuating member 19 extending from the motor 16 to the cutting blade assembly 10, then the head portion 9 is fixedly mounted to the housing 3 and so is prevented from rotating relative to the housing 3.

To trim hair to a desired length, a user then slides the comb attachment 20 over the head portion 9, with the elongate arcuate mounting section 25 sliding into the housing 3 and the rails extending over the cutting blade assembly 10. The mounting section 25 removably mounts to the end cover 13 and the retaining mechanism (not shown) fixedly holds the comb attachment 20 in place. Although in the present embodiment the comb attachment fixedly mounts to the end cover 13, it will be appreciated that the comb attachment 20 may be fixedly connected to a component, such as the motor housing 18 which rotates together with the head portion 9. The comb attachment 20 may also mount to an adjustment mechanism (not shown), which is configured to move the rails 22 towards and away from the cutting blade assembly 10. This enables the spacing between the cutting edge 11 of the cutting blade assembly 10 and the rails 22 to be varied and so change the length of hair to be cut by a user.

As the comb attachment 20 is slid over the head portion 9, the inwardly facing tabs (not shown) extending from the mounting section 25 abut the end face 51 of each locking member 52. As the comb attachment 20 is slid further, the tabs urge act against said end faces 51 and urge each locking member 52 against the resilience of the resilient elements (not shown) and away from the head portion 9 of the device. Therefore, the locking members 52 slide relative to the locking protrusions 56 from an engaged position, in which the head portion is prevented from rotating relative to the body 2, to a disengaged position whereby the contact surface 55 of each locking member 52 is separated from the locating surface 57 of the respective locking protrusion 56. Once the locking members 52 and locking protrusions 56 are spaced from each other, the motor housing 18 and therefore the head portion are free to rotate, and so in the disengaged position, the head portion 9 is rotatable relative to the body 2.

It will be understood that once the comb attachment 20 is fixedly attached to the head portion 9, then the locking members 52 are retained in their disengaged position. The user then operates the device 1 by use of the operating button 8. Electrical power is supplied to the electric motor 16 by power supply means, such as a battery, disposed in the electrical component space 17. The motor 16 then drives the cutting blade assembly 10 in a conventional manner, and the device 1 is then operable to trim hair.

As a user applies the device to a human head, the head portion 9 is free to pivot relative to the body 2 because the head portion 9 has some rotational freedom. Therefore, it is easier and more comfortable to use, because the head portion 9 and comb attachment 20 are rotatable to follow the shape of a human head. As the head portion 9 rotates, together with the comb attachment 20, the motor assembly also rotates because it is rotatably mounted in the housing 3 and is physically connected thereto by means of the actuating rod 19. Therefore the cutting efficiency of the device is retained.

As the head portion 9 rotates the comb attachment 20 also rotates. Therefore, the tabs of the comb attachment slide relative to the end surface 51 of the locking member 52. However, the tabs are prevented from sliding off the end surface 51 because they extend in a circumferential direction.

When a user removes the device from the human head, the head portion 9 and comb attachment 20 rotate back into the neutral position due to one or more return springs (not shown) mounted in the housing and fixedly attached to the motor housing 18, which in turn is physically mounted to the head portion 9. However, it will be appreciated that in another embodiment the return springs may be mounted directly to the head portion 9.

If a user desires to use the device to precisely style the outer contours of the hair or the like, then the user then detaches the comb attachment 20 from the head portion 9. When the user exerts a detaching force on the comb attachment 20 by pulling it away from body 2, the comb attachment is released from the retaining mechanism (not shown) and the comb attachment slides from the head portion 9. The tabs (not shown) are then slid away from the end surface of the locking member 52 and the resilient elements (not shown) urge each respective locking member 52 towards the locking protrusions 56, from their disengaged position to their engaged position.

The contact surface 55 of each locking member 52 then locates against the corresponding locating surface 57 of the respective locking protrusion to abut there against, and so the motor housing 18 and therefore the head portion 9 are prevented rotating relative to the housing. This aids the precise trimming of hair when the comb attachment 20 is not attached to the head portion 9.

If a user removes the comb attachment whilst the head portion 9 is in a rotated position, then the tabs (not shown) are then slid away from the end surface of the locking member 52 and the resilient elements (not shown) urge each respective locking member 52 towards the locking protrusions 56. The end surface 51 of each locking member 52 then abuts against an end face 59 of each locking protrusion. The return springs (not shown) urge the head portion 9 into the neutral position and the end face 59 of each locking protrusion slides relative to the end surface 51 of each locking member 52. As the head portion 9 locates in its neutral position, whereby the head portion 9 is not rotated relative to the body 2, then each locking protrusion 56 disengages from the end surface 51 of its respective locking member 52, and the locking member is urge to slide into its engaged position. The head portion 9 is then prevented from pivoting relative to the body 2.

Although the locking means 50 as described above comprises locking members 52 which locate against locking protrusions which extend from the motor housing 18, it will be appreciated that in an alternative embodiment the locking protrusions extend from the head portion 9, for example the end cover 13 such that the locking members 52 directly engage with the head portion 9. In particular, the locking members 52 may abut against engaging arms 60 (refer to FIG. 14), extending from the end cover 13, when the head portion locking means is in its engaged position, whereby the comb attached 20 is detached from the head portion 9, to prevent rotation of the head portion 9 relative to the body 2.

Although in this embodiment the head portion locking means 50 comprises two locking members 52 spaced diametrically opposite each other in the housing 3 which abut against two locking protrusions extending from the motor housing 18, it will be appreciated that in an alternative embodiment the locking means 50 has a single locking member 52 which locates against a single locking protrusion, or a pair of locking protrusions to prevent rotation of the motor housing 18 and hence the head portion 9 relative to the housing 2.

Although in the above embodiments the device is used for trimming, cutting or clipping hair on a human head, it will be appreciated that the device is suitable for use in trimming, cutting or clipping hair on animals and other parts of a human body.

Although claims have been formulated in this application to particular combinations of features, it should be understood that the scope of the disclosure of the present invention also includes any novel features or any novel combinations of features disclosed herein either explicitly or implicitly or any generalization thereof, whether or not it relates to the same invention as presently claims in any claim and whether or not it mitigates any or all of the same technical problems as does the parent invention. The applicants hereby give notice that new claims may be formulated to such features and/or combinations of features during the prosecution of the present application or of any further application derived there from.

The invention claimed is:

1. A device for trimming hair comprising a housing and a head portion with a cutting blade assembly, wherein the head portion is rotatably mounted to the housing and a comb attachment is releasably attachable to the device to extend over the cutting blade assembly, the device further comprising a locking means configured to lock the head portion to the housing when the comb attachment is detached from the device such that the head portion is prevented from rotating relative to the housing, and to unlock the head portion from the housing when the comb attachment is attached to the device such that the head portion is rotatable relative to the housing, wherein the comb attachment is releasably mounted to the head portion, and wherein the comb attachment comprises an urging protrusion which acts on the locking member to urge the locking member into its disengaged position.

2. A device according to claim 1, wherein the locking means further comprises a locking member which is configured to move between an engaged position, in which the head portion is prevented from rotating relative to the housing when the comb attachment is detached from the device, and a disengaged position, in which the head portion is rotatable relative to the housing when the comb attachment is attached to the device.

3. A device according to claim 2, wherein the locking member is urged into its disengaged position by the comb attachment acting on the locking member.

4. A device according to claim 2, further comprising resilient means to urge the locking member from its engaged position into its disengaged position.

5. A device according to claim 2, wherein the locking member is mounted in the housing.

6. A device according to claim 5, wherein the locking means further comprises a locking protrusion which rotates with the head portion such that, when the locking member is in its engaged position, the locking member abuts against the locking protrusion to prevent the head portion from pivoting relative to the housing.

7. A device according to claim 6, further comprising a motor assembly disposed in the housing to drive the cutting blade assembly, wherein the motor assembly rotates with the head portion and the locking protrusion extends from the motor assembly.

8. A device according to claim 6, wherein the locking protrusion extends in a radial direction from the axis of rotation of the motor assembly, and the locking member moves along an axis parallel to the axis of rotation.

9. A device according to claim 2, wherein the locking member is mounted on the head portion.

10. A device according to claim 9, wherein the locking member further comprises a slot and the locking means further comprises a locking pin which is locatable in the slot to fixedly mount the head portion relative to the housing and prevent rotation relative thereto.

11. A device according to claim 10, wherein the locking pin is disposed on the housing.

12. A device according to claim 10, wherein the locking member further comprises an arcuate face, along which the locking pin slides when the locking member is urged into its engaged position.

13. A device according to claim 9, wherein an arm of the locking member extends through an aperture in the head portion against which the comb attachment abuts to urge the locking member.

14. A device for trimming hair comprising a housing and a head portion with a cutting blade assembly, wherein the head portion is rotatably mounted to the housing and an attachment is releasably attachable to the device to extend over the cutting blade assembly, the device further comprising a locking member configured to move between an engaged position, in which the head portion is prevented from rotating relative to the housing when the attachment is detached from the device, and a disengaged position, in which the head portion is rotatable relative to the housing when the attachment is attached to the device, wherein the attachment is releasably mounted to the head portion, and wherein the attachment comprises an urging protrusion which acts on the locking member to urge the locking member into its disengaged position.

15. A device according to claim 14, wherein the locking member is urged into its disengaged position by the attachment acting on the locking member.

16. A device according to claim 14, further comprising resilient means to urge the locking member from its engaged position into its disengaged position.

17. A device according to claim 14, wherein the locking means further comprises a locking protrusion which rotates with the head portion such that, when the locking member is in its engaged position, the locking member abuts against the locking protrusion to prevent the head portion from pivoting relative to the housing.

18. A device according to claim 17, further comprising a motor assembly disposed in the housing to drive the cutting blade assembly, wherein the motor assembly rotates with the head portion and the locking protrusion extends from the motor assembly.

19. A device according to claim 18, wherein the locking protrusion extends in a radial direction from the axis of rotation of the motor assembly, and the locking member moves along an axis parallel to the axis of rotation.

20. A device according to claim 14, wherein the locking member further comprises a slot having a locking pin therein to fixedly mount the head portion relative to the housing and prevent rotation relative thereto.

21. A device according to claim 20, wherein the locking member further comprises an arcuate face, along which the locking pin slides when the locking member is urged into its engaged position.

22. A device according to claim 14, wherein an arm of the locking member extends through an aperture in the head portion against which the attachment abuts to urge the locking member.

* * * * *